US008381820B2

(12) United States Patent
Martinez

(10) Patent No.: US 8,381,820 B2
(45) **Date of Patent: *Feb. 26, 2013**

(54) IN-WELL RIGLESS ESP

(75) Inventor: Ignacio Martinez, Rio de Janeiro (BR)

(73) Assignee: Baker Hughes Incorporated, Houston, TX (US)

( * ) Notice: Subject to any disclaimer, the term of this patent is extended or adjusted under 35 U.S.C. 154(b) by 359 days.

This patent is subject to a terminal disclaimer.

(21) Appl. No.: 12/707,843

(22) Filed: Feb. 18, 2010

(65) Prior Publication Data

US 2010/0206577 A1 Aug. 19, 2010

Related U.S. Application Data

(60) Provisional application No. 61/153,376, filed on Feb. 18, 2009.

(51) Int. Cl.
*E21B 43/00* (2006.01)

(52) U.S. Cl. ..... 166/369; 166/68; 166/105

(58) Field of Classification Search ..... 166/68, 166/68.5, 105, 106, 107, 109, 369, 372
See application file for complete search history.

(56) References Cited

U.S. PATENT DOCUMENTS

| | | | | |
|---|---|---|---|---|
| 4,580,952 | A * | 4/1986 | Eberle | 417/383 |
| 6,668,925 | B2 * | 12/2003 | Shaw et al. | 166/265 |
| 6,873,267 | B1 * | 3/2005 | Tubel et al. | 340/853.3 |
| 2004/0159444 | A1 * | 8/2004 | Wolters et al. | 166/381 |
| 2007/0289747 | A1 * | 12/2007 | Shaw et al. | 166/368 |
| 2011/0011596 | A1 * | 1/2011 | Martinez et al. | 166/372 |

OTHER PUBLICATIONS

Power Connector Products, Copyright Tronic Ltd—Jun. 2005, www.tronicweb.com.

* cited by examiner

*Primary Examiner* — Giovanna Wright
*Assistant Examiner* — Richard Alker
(74) *Attorney, Agent, or Firm* — Bracewell & Giuliani LLP

(57) ABSTRACT

An in-well ESP string that can be installed or retrieved with a wireline instead of a rig. The ESP is combined with a motor and a hydraulic valve to pump formation fluid from a well to the surface. A wet connector is used to facilitate electrical and hydraulic connections. The ESP system is disposed within a tubing string located within the casing of a well. The hydraulic valve controls the flow of formation fluid to the ESP, opening to allow formation fluid to flow to the ESP, and closing to shut off production. When the valve is closed, the ESP may be cleaned with brine introduced via a flow port in the valve. This cleaning operation allows the ESP string to be to retrieved in an environmentally friendly manner. In addition, the wireline installation and retrieval is significantly less costly and less complicated than currently possible with a rig.

17 Claims, 5 Drawing Sheets

IN-WELL RIGLESS ESP

CROSS-REFERENCE TO RELATED APPLICATION

This application claims priority to provisional application 61/153,376 filed Feb. 18, 2009.

FIELD OF THE INVENTION

This invention relates in general to installation and retrieval of electrical submersible pumps (ESPs), and in particular to a string for the installation and retrieval of ESP equipment without a rig.

BACKGROUND OF THE INVENTION

ESP's are used in wells to pump formation fluids, such as oil, up to the surface via production tubing. Generally a rig is required to install and retrieve an ESP and its components down and out of the well. Once in place the ESP system controls the production of fluid to the surface.

It is desirable to install and remove ESP systems in a cost-effective, simplified, and environmentally friendly manner. However, the rig is a critical and expensive resource in subsea or remote applications. In addition, retrieval of the ESP can be environmentally harmful because formation fluid can contaminate the environment.

A technique is thus needed to install and retrieve ESP systems that is cost-effective and environmentally friendly.

SUMMARY OF THE INVENTION

In an embodiment of the present invention, an in-well ESP string is illustrated that can be installed or retrieved without the use of a rig. The in-well rigless ESP system includes a tubing string, a tubular assembly on the lower end of the tubing string, and a wet connector connected to a hydraulic line and a power cable. A power source outside the well is connected to the power cable, which is fastened to the outside of the tubing string. The hydraulic line is also fastened to the outside of the tubing string and is connected to a hydraulic source outside the well. A through tubing assembly that includes an ESP, mates with the wet connector to provide electrical power to the motor. An upper packer above an intake of the ESP that comprises part of the through tubing assembly, seals a discharge of the ESP from an intake of the ESP. When the through tubing assembly lands at the desired location within the well, the upper packer is set via hydraulic fluid supplied to the packer by an interior hydraulic line running from the wet connector to the upper packer.

The in-well rigless ESP system is run via wireline, coiled tubing, or cable within a production tubing string in well casing and has a base that connects to a previously installed hydraulic valve and flow port. The base of the ESP system mates into the tubing string. Another hydraulic control line connects to the hydraulic valve that when pressurized, opens the valve to allow flow from the formation during production. The valve can also be closed to prevent flow. The port allows brine to be circulated through the ESP to clean it prior to retrieval. The valve and flow port assembly is landed on a lower packer previously installed in the well.

A tubing hanger is attached to the top of the tubing string that lands in a wellhead to support the string of tubing. An electrical penetrator on the tubing hanger is used to route the power cable and hydraulic lines adjacent and external to the tubing string. The penetrator allows passage of the required cables and lines while preventing communication of the seawater from entering the well or well fluid from being in communication with the environment. For existing wells where space may prevent the penetrator from passing through the hanger, a swage can be connected to the top of the well casing to provide the necessary space to use a larger tubing hanger that would allow the penetrator to pass through the hanger without the need to reduce the diameter of the tubing string.

The invention is simple and allows for cost-effective ESP installation and retrieval via a wireline or coiled tubing. This invention further advantageously allows for environmentally friendly retrieval of an ESP system by cleaning the ESP prior to retrieval from the well. This invention could help operators decrease the overall cost of installation and retrieval of ESP systems.

DETAILED DESCRIPTION OF THE INVENTION

Figure 1:
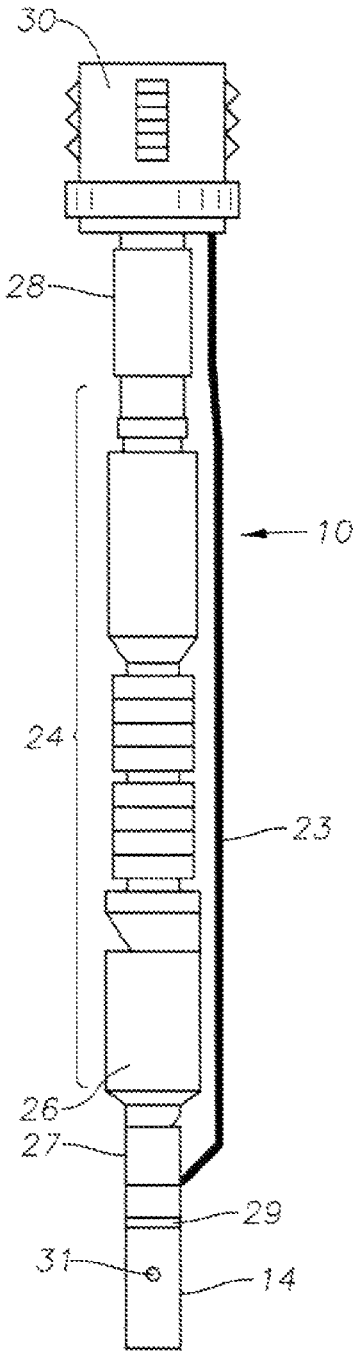
FIG. 1 shows the retrievable ESP prior to lowering into the wellbore, in accordance with the invention.
Figure 2:
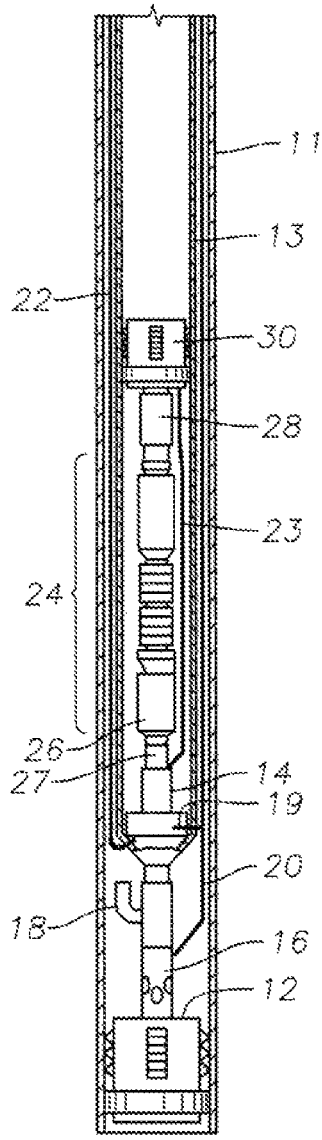
FIG. 2 show the complete tubing string system, including the retrievable ESP shown in FIG. 1, in accordance with the invention.
Figure 3:
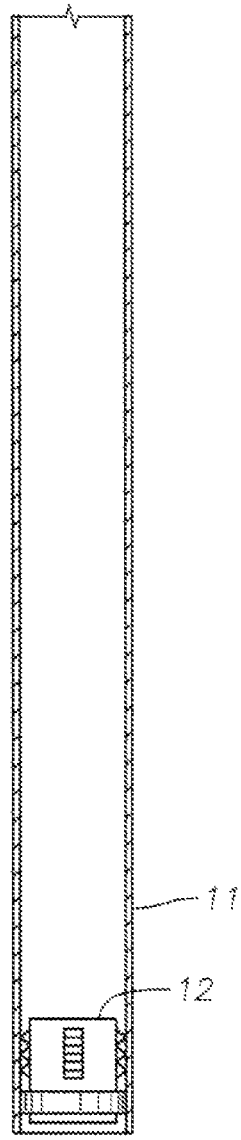
FIG. 3 shows the first run to set a packer in accordance with the invention.

Referring to FIGS. 1 and 2, an embodiment of an in-well rigless ESP system 10 is shown outside and inside a tubing string 13 and a casing 11, respectively. The in-well rigless ESP system 10 includes a wet connector 14 that connects a hydraulic control line 19 to set a hydraulic packer 30, and also connects a power cable 22 to power a motor 26 of the ESP 24. The wet connector 14 is located in a tubular assembly. The tubular assembly is rigidly attached to the lower end of the tubing string 13. The wet connector 14 allows the power cable 22 and control line 20 coining from the surface to provide power to the ESP 24 and hydraulic control to the packer 30. A stinger 27 approximately at the base of the ESP system 10 has electrical conductors 29 that mate with electrical conductors in the wet connector and hydraulic ports 31 that mate with hydraulic ports in the wet connector. The packer 30 will seal the discharge of the ESP 24, which is driven by the motor 26 located at its base. An expansion joint 25 is located between the ESP 24 and the packer 30 to compensate for thermal expansion in the string. The system 10, may experience expansion due to the temperatures experience in the well 11, as such, the expansion joint 28 reduces stress on the packer 30 and the components of the ESP system 10 by expanding and contracting in response to changes in temperature. The in-well rigless ESP system 10 is run within a production tubing string 13 in casing well 11 and has a base that connects to a previously installed hydraulic valve 16 and flow port 18. The base of the ESP system 10 mates with the tubing string 13. Another hydraulic control line 20 connects to the hydraulic valve 16. When control line 20 is pressurized, the valve 16 opens to allow flow from the formation during production and can be closed to prevent flow. The flow port 18 allows brine to be circulated through the ESP 24 to clean it. The valve 16 and flow port 18 assembly is landed on a permanent packer 12 previously installed.

FIGS. 3 through 11 illustrate the installation of the in-well rigless ESP system 10. The system refers to the whole string. In the first run shown in FIG. 3, a lower packer 12 is set within the well 11 above perforations to the earth formation and at the approximate location where the base of the tubing string with the ESP system 10 will be located. The packer 12 may be either permanent or retrievable. A rig (not shown) is used to run the packer 12 down the well 11. It is typically run on a conduit such as tubing or drill pipe or wireline.

Figure 4:
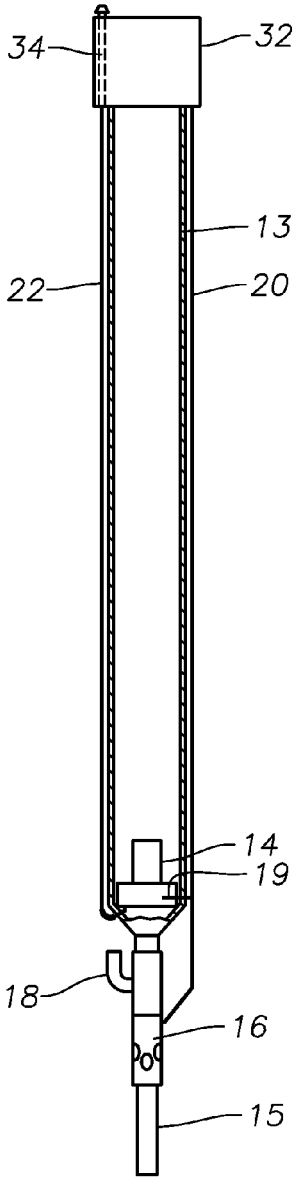
FIGS. 4 and 5 show a tubing string including a seal assembly, hydraulic valve, flow port or similar valve, and wet connector, installed in the second run, in accordance with the invention.

As shown in FIG. 4, a seal assembly 15 is connected to the base of a hydraulic actuated valve 16 which in turn is connected to the flow port 18. The hydraulic valve 16 can be opened to allow fluid to flow from the formation and up the tubing string 13. The hydraulic valve 16 can also be closed to shut off production from the formation. When flow from the formation is shut off, the flow port 18 allows brine introduced into the annulus to be circulated through the ESP 24 to clean it prior to removal. The flow port 18 has an internal check valve (not shown) that only allows flow into the flow port 18 and thus prevents oil entering through the hydraulic valve 16 from entering into the annulus space during production. Further, during cleaning of the ESP 24, the hydraulic valve 16 is closed to prevent flow of oil and the check valve allows the brine introduced into the annulus to flow into flow port 18.

Figure 5:
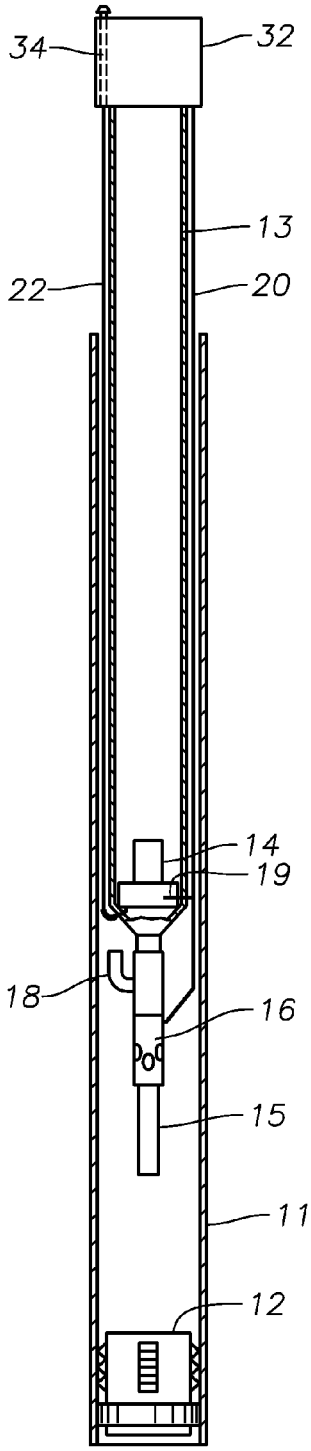

A lower section of wet connector 14 is located above the flow port 18 and the upper section of the wet connector 14 is within the tubing string 13. A tubing hanger 32 is attached to the top of the tubing string 13. Tubing hanger 32 lands in a wellhead to support the string of tubing 13. The power cable 22 and two hydraulic lines 20 run adjacent and external to the tubing string 13. An electrical penetrator 34 in tubing hanger 32 is used to pass the power cable 22 signal through the tubing hanger 32. The penetrator 34 is fixed in the tubing hanger 32 and allows the electrical power cable 22 to be run into the well while isolating the annulus of the well 11 from the environment. Further, hydraulic sports 21 (FIG. 15) are used to pass the hydraulic control lines 20 through the tubing hanger 32. To minimize the amount of space required, the penetrator can be a 3-leg style with a single penetrator 34 per phase. A single mandrel penetrator can be used if there is enough space on the tubing hanger. The two control lines 20 pass through hydraulic connector ports 21 (FIGS. 14 and 15) on the tubing hanger 32. The power cable 22 is clamped to the electrical connection of the wet connector 14 to serve the ESP motor 26, and one control line 19 is clamped to the hydraulic connection of the wet connector 14 to set the hydraulic packer 30. The other control line 20 is clamped directly to the hydraulic valve 16 to provide actuation. The control line 20 serving the hydraulic valve 16 can also be pressurized and observed for pressure drop as a means to test the packer 30. The inability of the hydraulic valve 16 to actuate correctly also indicates whether the packer 30 is set correctly. The assembly shown in FIG. 4 is then lowered into the well 11 by rig (not shown) in the second run as shown in FIG. 5, using clamps to support and protect the hydraulic lines 20 and power cable 22. The assembly is lowered until the seal assembly 15 of the tubular assembly stabs into a receptacle in a lower packer 12. The lower packer 12 is not located at the bottom of the well but instead is set above perforations to the earth formation.

The in-well rigless ESP system 10 shown in FIG. 1 may then be transported to the well 11 site by truck (not shown) if the well is onshore. If the well 11 is offshore, the ESP system 10 may be transported by vessel (not shown). In the first installation, the in-well rigless ESP system 10 can be assembled and/or transported on the rig. The maximum length of the in-well rigless ESP system 10 is preferably about 70 feet to facilitate transportation but can be of any length suitable for transporting. If the ESP system is not short enough for vessel transportation, the transportation procedure can be modified to allow assembly of the ESP system 10 horizontal or vertical to the vessel.

Figure 6:
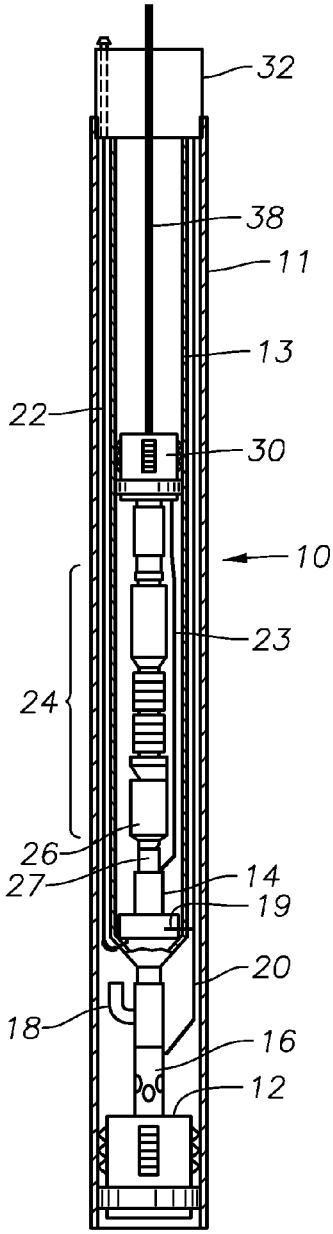
FIG. 6 shows the rigless ESP string shown in FIG. 1 lowered into the well inside the tubing string shown in FIG. 4, by wireline in accordance with the invention.

Unlike the prior art, the in-well rigless ESP system 10 can then be run into the well 11 without the use of a rig, as illustrated in FIG. 6. Rather, a wireline winch (not shown) can be used to run the ESP system 10 into the casing 11 through the bore of the tubing hanger 32 and inside the tubing string 13 using a wireline 38. Alternatively, coiled tubing may be used to run the ESP system 10 into the casing 11. The ESP system 10 is lowered into the well 11 until the upper section of the wet connector 14 attached to the bottom of the ESP motor 26 engages the lower section of the wet connector 14 and is thereby electrically supplied by the power cable 22 and hydraulically supplied by the control lines 20. The motor 26 is attached to the bottom portion of the ESP 24. Packer 30 is set to seal the discharge of the ESP 24 from its intake.

Figure 8:
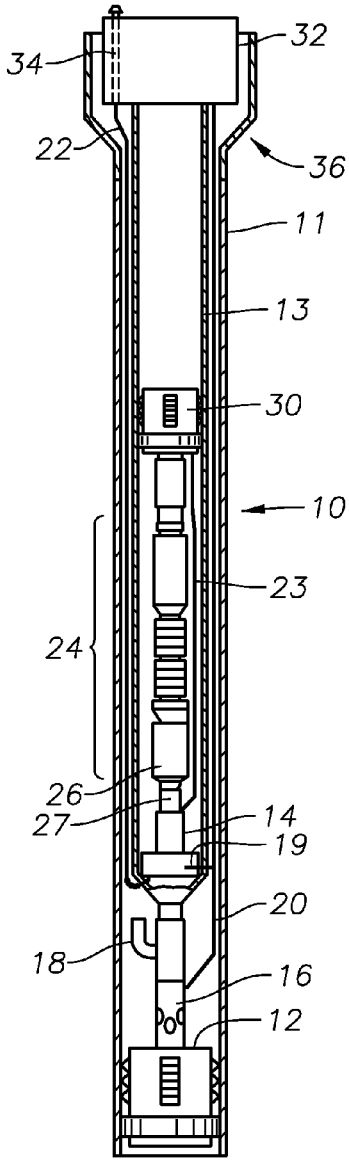
Figure 14:
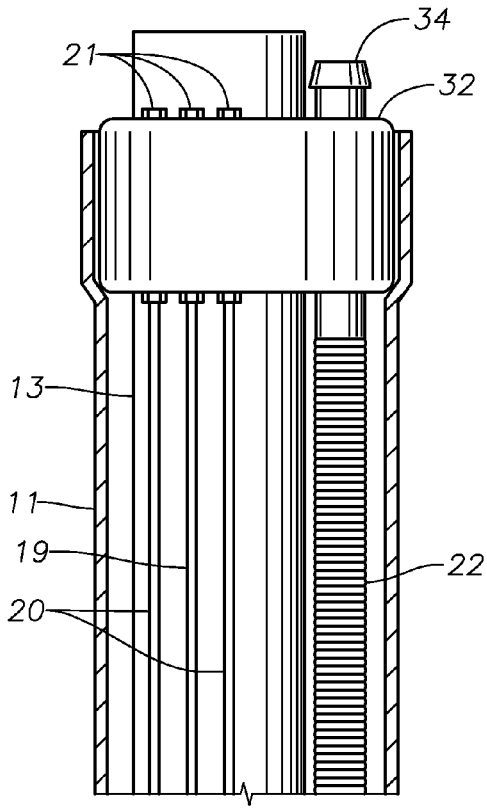
FIGS. 14 and 15 show a typical electrical penetrator and hydraulic connector arrangement in a tubing hanger, in accordance with the invention.
Figure 15:
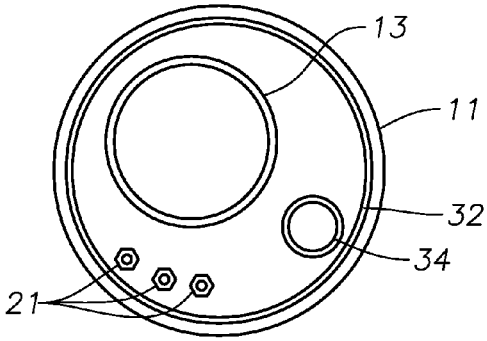

If the packer 30 at the top of the ESP system 10 is set mechanically via wireline or any other method used to run the rigless ESP 20, it can then be pressure tested using the same hydraulic control line 20 that connects to the hydraulic valve 16 by pressurizing the control line 20 and observing whether the pressure is maintained. Alternatively, another control line 20 can be connected to the wet connector 14 to supply pressure to a control line running from the wet connector 14 to the two seals (not shown) on the packer 30. The control line 20 can then be observed for pressure changes. FIGS. 8 and 14 show different hanger 32 and penetrator 34 arrangements to allow the ESP system 10 to nm into the well 11. If the packer 30 is hydraulically set, the hydraulic control line 20 connected to the wet connector 14 will be pressurized to set the packer 30. Then the control line 20 serving the hydraulic valve 16 will be used to pressure test the packer 30 by observing whether or not pressure is maintained.

Figure 7:
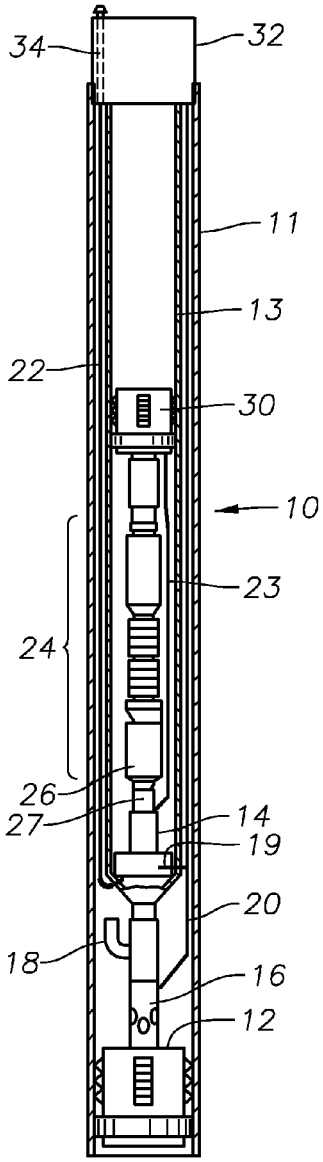
FIGS. 7 and 8 show the rigless ESP string in the well with wellhead hangers and penetrators installed in accordance with the invention.

FIG. 7 illustrates a new well with casing 11 having a tubing hanger 32 that is about the same diameter as the casing 11 and has a larger diameter than the tubing string 13 to allow for the largest ESP 24 to be run while still allowing the penetrator 34 to pass through the wall of the hanger 32. For existing wells 11 where space would prevent the penetrator 34 from passing the hanger 32, a swage 36 (FIG. 8) is connected to the top of the casing 11. The swage 36 would provide the necessary space to use a larger tubing hanger 32 that would allow the penetrator 34 to pass through the hanger 32 without the need to reduce the diameter of the tubing string 13. A typical electrical penetrator 34 and hydraulic connector port 21 assembly in a hanger 32 is shown in FIG. 14 with a top view shown in FIG. 15.

Figure 9:
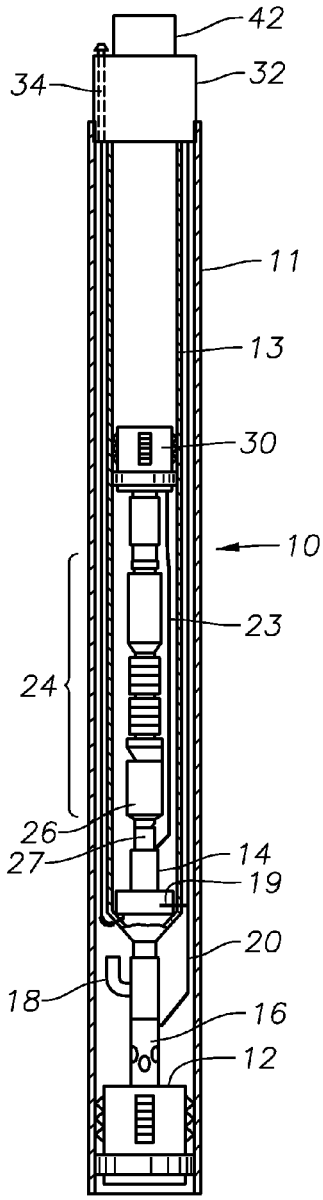
FIG. 9 shows completion of the well with installation of a horizontal christmas tree in accordance with the invention.
Figure 10:
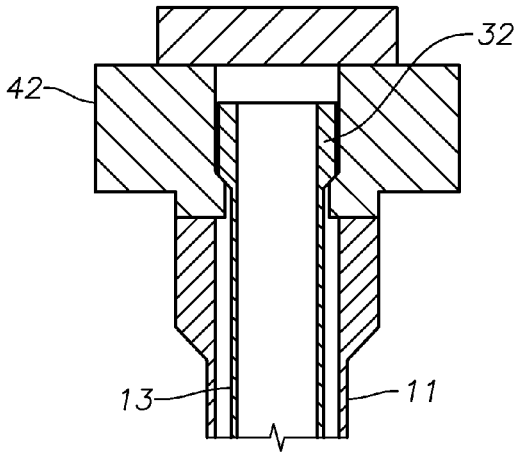
FIG. 10 shows a typical horizontal christmas tree with a cap, in accordance with the invention.

FIG. 9 illustrates completion of the well 11 with the installation of a tree 42 (FIG. 10) such as a horizontal christmas tree for subsea wells at the tubing hanger 32. Installation of horizontal christmas tree 42 requires the use of a rig and would have been installed before the ESP 10 was run through it and into the well 11. The wireline 38 (FIG. 6) is detached from packer 30 and retrieved by the winch (not shown). Alternatively, surface piping (not shown) can be connected at the wellhead for onshore wells. Once the tree cap on the tree 42 is in place, the hydraulic control line 20 connecting directly to the hydraulic valve 16 is pressurized from a hydraulic source (not shown) to open the hydraulic valve 16. When the hydraulic valve 16 is open, well fluid from below permanent packer 12 can flow through the hydraulic valve 16 and into the tubing string 13. The hydraulic valve 16 opens into the tubing string 13 to prevent contact between the fluid and the annulus. If hydraulic pressure in control line 20 connected to the hydraulic valve 16 is released, the valve 16 will close, as it is a close to fail type valve. As explained above, if the packer 30 is hydraulic, it will be set by the control line 19 connecting to the wet connector by pressurizing a hydraulic line that runs from the wet connector 14 to the packer 30. The packer 30 will be pressure tested The control line 20 connecting directly to the hydraulic valve 16 is pressurized to open the valve 16 and also serves to test the packer by indicating whether pressure in the control line 20 is maintained. The ESP 24 is ready to produce oil from the formation up through the tubing 13.

Figure 11:
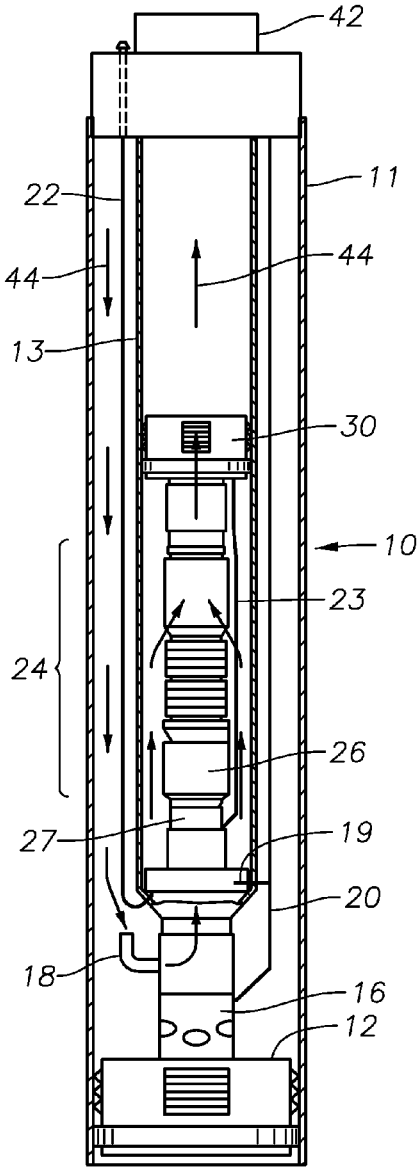
FIG. 11 shows an enlarged view of the circulation of brine or other fluid to clean the rigless ESP string in preparation for pulling the retrievable ESP in accordance with the invention.
Figure 12:
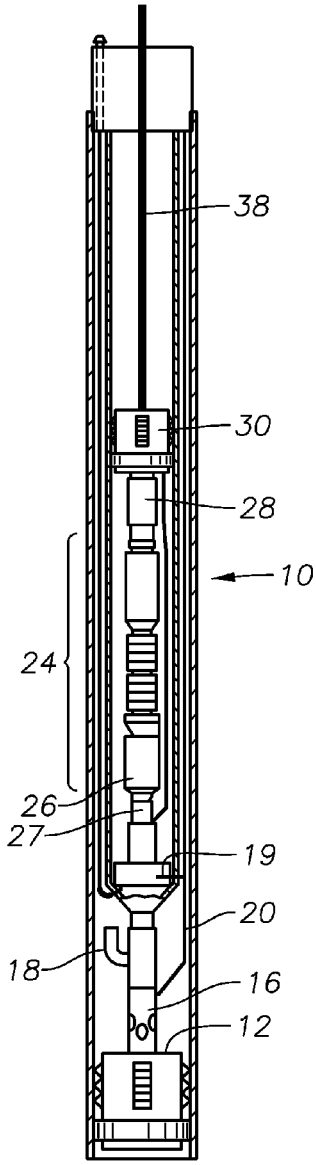
FIG. 12 shows a wireline or coiled tubing connected to hydraulic packer in preparation for pulling of rigless ESP string in accordance with the invention.
Figure 13:
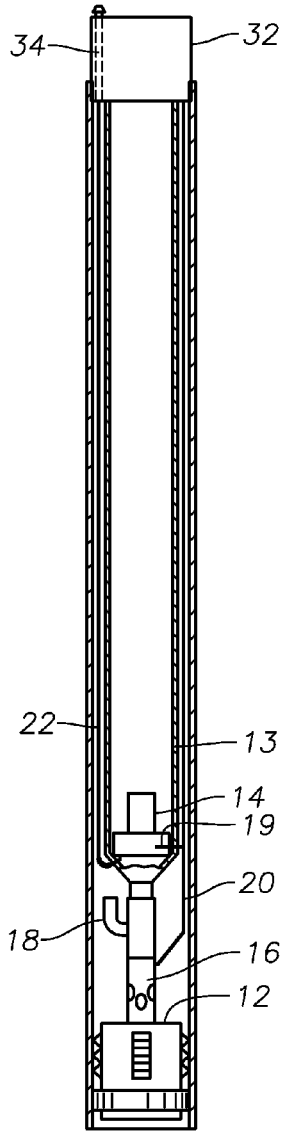
FIG. 13 shows the rigless ESP string pulled from the well and well ready to receive a replacement ESP string in accordance with the invention.

FIGS. 11-13 illustrate the process for retrieving the in-well rigless ESP 10 from the well 11 for maintenance, repair, or replacement of the ESP 24, the ESP motor 26 or any of the other components that make up the rigless ESP 10. To begin the retrieval procedure, hydraulic pressure to the hydraulic valve 16 is released to close the valve 16, as shown in FIG. 11. This shuts off the formation below packer 12 to prevent production. Brine 44 or any other suitable fluid is then circulated down the annulus formed by the inner wall of the casing 11 and the outer wall of the tubing string 13 as shown in FIG. 11. The brine 44 further circulates through the flow port 18, into the tubing string 13, flows into the ESP 24 intake, and flows out of the ESP 24 discharge. The circulation of brine in this manner cleans the in-well rigless ESP 10 and prepares it for pulling in an environmentally friendly manner. The flow port 18 has an internal check valve (not shown) that only allows brine 44 to enter and prevents it from exiting.

The tree cap on the christmas tree 42 (FIGS. 9, 10) is removed by wireline or by a remotely operated vehicle, and a wireline 38 is run down the well 11 and connected to the packer 30 as shown in FIG. 12. The cap on the christmas tree 42 can be safely removed because the hydraulic valve 16 is closed and the column of brine 44 in the tubing 13 is heavier than the pressure below the hydraulic valve 16. The pressure to the control line 19 connected to the wet connector 14 to serve the packer 30 is released and the packer 30 is released. If the packer 30 is mechanical, it will include a straight-pull release mechanism to release the packer by upward pull on wireline 38. A packer 30 with a rotate release mechanism will require the use of coiled tubing to release the packer 30. Further, a hydraulically set packer 30 may also be released mechanically via overpulling with the wireline 38. Once the packer 30 is released, the in-well rigless ESP 10 is pulled out of the well 11 as shown in FIG. 13, leaving the well 11 in condition to receive another ESP and other components as shown in FIG. 13. The well 11 is left with the permanent packer 12, tubing 13, hydraulic valve 16, flow port 18, and wet connector 14 in place, as shown in FIG. 13. The control lines 20 and power cable 22 remain connected to the wet connector 14 and the wellhead hanger 32 and penetrator 34 also remain in place.

In another embodiment (not shown), coiled tubing instead of a wireline can be used to lower and retrieve the in-well rigless ESP 10. A spool of coiled tubing can be located at the onshore wellhead or on the vessel for an offshore well to achieve this.

In an additional embodiment, the wet connector 14 can be assembled as part of the ESP motor 26.

In an additional embodiment, three control lines 20 are used to actuate the hydraulic valve 16 and set and test the packer 30. One control line 20 connects directly to the hydraulic valve 16 and another control line 19 is connected to a hydraulic connector on the wet connector 14 to set the packer 30. A third control line is also connected to a hydraulic connector on the wet connector 14 to observe whether pressure is maintained between the seals (not shown), thus testing the packer 30.

In an additional embodiment, the hydraulic valve 16 is actuated through the application of annular pressure. A fluid such as brine 44 is introduced into the annulus to provide the required pressure to actuate the hydraulic valve 16. Cycling the pressure in the annulus will open and close the hydraulic valve.

Generally a rig is required to install and retrieve an ESP and its components down and out of the well. The rig is a critical and expensive resource in subsea or remote applications. The assembled string 10 with the ESP 24, packer 30, expansion joint 28, and motor make it less costly to replace a complete ESP string 10 by using a wireline 38 to pull the string 10 rather than a rig. By using an electrical/hydraulic wet connector, the system provides power to the ESP motor 26 and hydraulic pressure to actuate hydraulic valve 16 and set the packer 30. The flow port 18 allows brine 44 to circulate through and clean the in-well rigless ESP 10 to allow retrieval in an environmentally friendly manner. Thus wireline pulling of a complete ESP string and not just the ESP itself is achieved in a significantly less costly and less complicated manner than is currently possible with a rig.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for producing fluid through a tubing string within a well, comprising:

a tubular assembly adapted to be secured to the lower end of the tubing string and lowered into the well with the tubing string;

an electrical and hydraulic wet connector receptacle located in the tubular assembly;

an electrical power cable adapted to be fastened to the outside of the tubing string and running from a power source outside the well and connecting to an electrical connection on the wet connector receptacle;

an exterior hydraulic line adapted to be fastened to the outside of the tubing string and running from a hydraulic fluid source outside the well and connecting to a hydraulic connection on the wet connector receptacle;

a through tubing assembly for lowering into the tubing string;

an electrical submersible pump and motor comprising part of the through tubing assembly, the through tubing assembly having a stinger with electrical contacts and a hydraulic port, the stinger stabbing into the wet connector receptacle such that the electrical contacts of the stinger mate with the electrical connection on the wet connector receptacle for providing electrical power to the motor via the electrical power cable and the hydraulic port on the stinger mates with the hydraulic connection on the wet connector receptacle for providing hydraulic fluid pressure to the through tubing assembly;

a hydraulic actuated upper packer comprising part of the through tubing assembly for sealing a discharge of the pump to an interior of the tubing string; and an interior hydraulic line running from the hydraulic port on the stinger to the upper packer to supply hydraulic fluid pressure to set the upper packer when the through tubing assembly lands on the tubular assembly.

2. The apparatus of claim 1, further comprising a lower packer adapted to be set in the well, the tubular assembly having a tubular seal assembly that lands within a receptacle of the lower packer.

3. The apparatus of claim 2, further comprising a hydraulic actuated valve in the tubular assembly that is also adapted to be lowered with the tubing string and allows fluid flow from below the lower packer through the tubular assembly to the pump when open and prevents fluid flow when closed.

4. The apparatus of claim 3, further comprising a second exterior hydraulic fluid line adapted to be fastened to the outside of tubing string and running from the hydraulic fluid source outside the well and connecting to the valve for actuating the valve.

5. The apparatus of claim 4, further comprising:

a flow port in the tubular assembly that selectively allows fluid on the exterior of the tubular assembly to flow into the tubular assembly to the pump; and wherein the flow port is closed to prevent fluid exterior of the tubular assembly from flowing into the flow port while the valve is open.

6. The apparatus of claim 2, further comprising:

a hydraulic actuated valve in the tubular assembly that allows fluid flow from below the lower packer through the tubular assembly to the pump when open and prevents fluid flow from below the lower packer when closed; and a flow port in the tubular assembly that blocks outward flow through the flow port and allows fluid on the exterior of the tubular assembly to flow into the tubular assembly to the pump while the valve is closed.

7. The apparatus of claim 1, further comprising a flow port in the tubular assembly that selectively allows fluid on an exterior of the tubular assembly to flow into an interior of the tubular assembly and to the pump.

8. The apparatus of claim 1, wherein the tubular assembly is attached to and protrudes downward from the tubing string as the tubing string is lowered into the well.

9. The apparatus of claim 1, wherein the upper packer releases if hydraulic pressure in the interior hydraulic line is removed.

10. The apparatus of claim 1, further comprising a cable that supports the through tubing assembly as the through tubing assembly is lowered into the tubing string.

11. An apparatus for producing fluid from a well, comprising:

a tubing string lowered into and suspended in the well;

a tubular assembly secured to the lower end of the tubing string and lowered into the well with the tubing string;

an electrical and hydraulic wet connector receptacle located in the tubular assembly, the wet connector receptacle having electrical contacts and a hydraulic port;

an electrical power cable fastened to an outside of the tubing string and running from a power source outside the well and connecting to the electrical contact on the wet connector receptacle;

an exterior hydraulic line fastened to the outside of the tubing string and running from a hydraulic fluid source outside the well and connecting to the hydraulic port on the wet connector receptacle;

a through tubing assembly lowered into the tubing string;

an electrical submersible pump and motor comprising part of the through tubing assembly;

a stinger on a lower end of the electrical submersible pump and motor having electrical contacts and a hydraulic port, the stinger stabbing into the wet connector receptacle, causing the electrical contact of the stinger to mate with the electrical contacts of the wet connector receptacle to supply electrical power to the motor, and the hydraulic port of the stinger mating with the hydraulic port of the wet connector receptacle;

an upper packer comprising part of the through tubing assembly for sealing a discharge of the pump to an interior of the tubing string;

an interior hydraulic line running within the tubing string from the hydraulic port of the stinger to the upper packer to supply hydraulic fluid to set the upper packer when the through tubing assembly lands on the tubular assembly;

a lower packer set in the well, the tubular assembly having a tubular seal assembly that lands within a receptacle of the lower packer; and a hydraulic actuated valve in the tubular assembly that allows fluid flow from below the lower packer through the tubular assembly to the pump when open and prevents fluid flow when closed.

12. The apparatus of claim 11, further comprising a flow port in the tubular assembly that selectively allows fluid on the exterior of the tubular assembly to flow into the tubular assembly to the pump.

13. The apparatus of claim 11, wherein the tubular assembly protrudes downward from the tubing string as the tubing string is lowered into the well.

14. The apparatus of claim 11, further comprising a cable that supports the through tubing assembly as the through tubing assembly is lowered into the tubing string.

15. A method for pumping fluid from a well, comprising:

making up a tubing string with a tubular assembly secured to a lower end of the tubing string, the tubular assembly having an electrical and hydraulic wet connector receptacle having electrical contacts and a hydraulic port;

lowering the tubing string into the well while at the same time extending alongside the tubing string an electrical power cable and an external hydraulic line leading from the wet connector receptacle;

assembling a through tubing assembly comprising an electrical submersible pump and motor, an upper packer, and a stinger on a lower end having electrical contacts and a hydraulic port, and connecting the hydraulic port to the upper packer with an internal hydraulic line;

lowering the through tubing assembly through the tubing string and stabbing the stinger into the wet connector receptacle;

supplying hydraulic fluid pressure through the external hydraulic line, wet connector receptacle and internal hydraulic line to the upper packer to set the upper packer in the tubing string; and supplying electrical power through the power cable and the wet connector receptacle to the motor to drive the pump.

16. The method of claim 15, further comprising connecting a hydraulic actuated valve in the tubular assembly, supplying hydraulic fluid power to the valve via a second external hydraulic line to the valve to open the valve and allow fluid flow through the tubular assembly to the pump.

17. The method of claim 16, further comprising:

installing a lower packer in casing in the well above a fluid producing formation;

sealingly stabbing a lower end of the tubular assembly into the lower packer; and installing a flow port in the tubular assembly and selectively opening the flow port and closing the vale to allow fluid in the casing above the lower packer to flow downward into the flow port and up into the tubular assembly.

* * * * *

UNITED STATES PATENT AND TRADEMARK OFFICE

CERTIFICATE OF CORRECTION

PATENT NO. : 8,381,820 B2
APPLICATION NO. : 12/707843
DATED : February 26, 2013
INVENTOR(S) : Ignacio Martinez It is certified that error appears in the above-identified patent and that said Letters Patent is hereby corrected as shown below:

In the Specification:

Column 3, line 7, delete the "," after "system 10"
Column 3, line 58, delete "sports" and insert --ports--

Signed and Sealed this
Seventeenth Day of September, 2013

Teresa Stanek Rea
*Deputy Director of the United States Patentand Trademark Office*